US008883388B2

(12) United States Patent
Kawauchi et al.

(10) Patent No.: US 8,883,388 B2
(45) Date of Patent: Nov. 11, 2014

(54) CARRIER CORE PARTICLE FOR ELECTROPHOTOGRAPHIC DEVELOPER, CARRIER FOR ELECTROPHOTOGRAPHIC DEVELOPER AND ELECTROPHOTOGRAPHIC DEVELOPER

(75) Inventors: Takeshi Kawauchi, Okayama (JP); Yukihiro Matsuda, Okayama (JP)

(73) Assignees: Dowa Electronics Materials Co., Ltd., Tokyo (JP); Dowa IP Creation Co., Ltd., Okayama (JP)

( * ) Notice: Subject to any disclaimer, the term of this patent is extended or adjusted under 35 U.S.C. 154(b) by 3 days.

(21) Appl. No.: 13/805,417

(22) PCT Filed: Jul. 26, 2011

(86) PCT No.: PCT/JP2011/066971

§ 371 (c)(1),
(2), (4) Date: Dec. 19, 2012

(87) PCT Pub. No.: WO2012/049900

PCT Pub. Date: Apr. 19, 2012

(65) Prior Publication Data

US 2013/0189614 A1 Jul. 25, 2013

(30) Foreign Application Priority Data

Oct. 15, 2010 (JP) ..... 2010-232729

(51) Int. Cl.
*G03G 9/107* (2006.01)
*G03G 9/113* (2006.01)

(52) U.S. Cl.
CPC ..... *G03G 9/1132* (2013.01); *G03G 9/1133* (2013.01); *G03G 9/1136* (2013.01); *G03G 9/107* (2013.01); *G03G 9/113* (2013.01)
USPC ..... 430/111.33; 430/111.31

(58) Field of Classification Search
CPC ..... G03G 9/107; G03G 9/113; G03G 9/1136
USPC ..... 430/111.35, 111.31, 111.33
See application file for complete search history.

(56) References Cited

U.S. PATENT DOCUMENTS

| | | | | |
|---|---|---|---|---|
| 5,595,850 | A * | 1/1997 | Honjo et al. | 430/111.33 |
| 2004/0185366 | A1* | 9/2004 | Shinmura et al. | 430/111.33 |
| 2006/0003248 | A1* | 1/2006 | Kobayashi et al. | 430/111.33 |
| 2006/0199093 | A1* | 9/2006 | Iinuma et al. | 430/111.31 |
| 2007/0087282 | A1* | 4/2007 | Iinuma et al. | 430/111.31 |
| 2007/0141502 | A1* | 6/2007 | Aga et al. | 430/111.32 |
| 2009/0233202 | A1* | 9/2009 | Anno et al. | 430/111.35 |
| 2010/0233608 | A1* | 9/2010 | Tsurumi et al. | 430/111.32 |
| 2010/0279224 | A1* | 11/2010 | Okamoto et al. | 430/111.1 |
| 2010/0310982 | A1* | 12/2010 | Ohtani et al. | 430/111.32 |

FOREIGN PATENT DOCUMENTS

| | | | |
|---|---|---|---|
| CN | 1116733 | | 2/1996 |
| CN | 1768307 | | 5/2006 |
| CN | 101120420 | | 2/2008 |
| EP | 0 691 582 | | 1/1996 |
| JP | 08194338 | A * | 7/1996 |
| JP | 09281752 | A * | 10/1997 |

(Continued)

*Primary Examiner* — Christopher Rodee
(74) *Attorney, Agent, or Firm* — Clark & Brody

(57) ABSTRACT

A carrier core particle for an electrophotographic developer including a core composition expressed by a general formula: $(Mn_xMg_yCa_z)\ Fe_wO_{4+v}$ ($x+y+z+w=3$, $-0.003<v$) as a main ingredient, wherein $0.05 \le y \le 0.35$ and $0.005 \le z \le 0.024$.

4 Claims, 3 Drawing Sheets

(56) References Cited

FOREIGN PATENT DOCUMENTS

| | | | |
|---|---|---|---|
| JP | 2003034533 | A * | 2/2003 |
| JP | 2006-337828 | | 12/2006 |
| JP | 2008-241742 | | 10/2008 |
| JP | 2009-237155 | | 10/2009 |
| JP | 2009-244788 | | 10/2009 |

* cited by examiner

CARRIER CORE PARTICLE FOR ELECTROPHOTOGRAPHIC DEVELOPER, CARRIER FOR ELECTROPHOTOGRAPHIC DEVELOPER AND ELECTROPHOTOGRAPHIC DEVELOPER

TECHNICAL FIELD

This invention relates to a carrier core particle for an electrophotographic developer (hereinafter, sometimes simply referred to as "carrier core particle"), a carrier for an electrophotographic developer (hereinafter, sometimes simply referred to as "carrier"), and an electrophotographic developer (hereinafter, sometimes simply referred to as "developer"). More particularly, this invention relates to a carrier core particle contained in an electrophotographic developer used in copying machines, MFPs (Multifunctional Printers) or other types of electrophotographic apparatuses, a carrier contained in an electrophotographic developer, and an electrophotographic developer.

BACKGROUND ART

Electrophotographic dry developing systems employed in a copying machine, MFP or other types of electrophotographic apparatuses are categorized into a system using a one-component developer containing only toner and a system using a two-component developer containing toner and carrier. In either of these developing systems, toner charged to a predetermined level is applied to a photoreceptor. An electrostatic latent image formed on the photoreceptor is rendered visual with the toner and is transferred to a sheet of paper. The image visualized by the toner is fixed on the paper to obtain a desired image.

A brief description about development with the two-component developer will be given. A predetermined amount of toner and a predetermined amount of carrier are accommodated in a developing apparatus. The developing apparatus is provided with a rotatable magnet roller with a plurality of south and north poles alternately arranged thereon in the circumferential direction and an agitation roller for agitating and mixing the toner and carrier in the developing apparatus. The carrier made of a magnetic powder is carried by the magnet roller. The magnetic force of the magnet roller forms a straight-chain-like magnetic brush of carrier particles. Agitation produces triboelectric charges that bond a plurality of toner particles to the surface of the carrier particles. The magnetic brush abuts against the photoreceptor with rotation of the magnet roller and supplies the toner to the surface of the photoreceptor. Development with the two-component developer is carried out as described above.

Fixation of the toner on a sheet of paper results in successive consumption of toner in the developing apparatus, and new toner in the same amount as that of the consumed toner is supplied, whenever needed, from a toner hopper attached to the developing apparatus. On the other hand, the carrier is not consumed for development and used as it is until the carrier comes to the end of its life. The carrier, which is a component of the two-component developer, is required to have various functions including: a function of triboelectrically charging the toner by agitation in an effective manner; an insulating function; and a toner transferring ability to appropriately transfer the toner to the photoreceptor. To improve the toner charging performance, for example, the carrier is required to have appropriate electric resistance (hereinafter, sometimes simply referred to as "resistance") and appropriate insulating properties.

The aforementioned carrier currently made is composed of a carrier core particle, which is a core or a base of the carrier, and coating resin for covering the surface of the carrier core particle.

The carrier core particle is desired to have good magnetic properties as a basic characteristic. Briefly speaking, the carrier is carried by a magnet roller with magnetic force in the developing apparatus. In the use situation, if the magnetism, more specifically, the magnetization of the carrier core particle is low, the retention of the carrier to the magnet roller becomes low, which may cause so-called scattering of the carrier or other problems. Especially, recent tendencies to make the diameter of a toner particle smaller in order to meet the demand for high-quality image formation require smaller carrier particles. However, the downsizing of the carrier particles could lead to reduction in the retention of each carrier particle. Effective measures are required to prevent scattering of the carrier.

Among the various disclosed techniques relating to the carrier core particle, Japanese Unexamined Patent Application Publication No. 2008-241742 (PL1) discloses a technique with the aim of preventing the carrier from scattering.

CITATION LIST

Patent Literature

PL1: JP-A No. 2008-241742

SUMMARY OF INVENTION

Technical Problem

As to the magnetic properties, the carrier core particle is required not only to just have a high value of magnetization in a high external magnetizing field and a high value of saturation magnetization that the particle finally reaches, but also to have excellent rise characteristics of the magnetization. In other words, the carrier core particle is required to reach a high magnetization level even in a low external magnetizing field environment to further prevent carrier scattering.

The carrier core particle is desired to have good electric properties, more specifically, to hold a large amount of charge and have a high dielectric breakdown voltage. In addition, in order to prevent carrier scattering, the carrier is desired to have an appropriate resistance. Especially, the carrier core particle tends to be greatly desired to have excellent charging performance.

In general, copying machines are installed and used in offices of companies; however, there are various office environments around the world. For instance, some copying machines are used under high-temperature environments at approximately 30° C., while some are used under high-humidity environments at approximately 75% RH. On the contrary, some copying machines are used under low-temperature environments at approximately 10° C., while some are used under low-humidity environments at approximately 35% RH. Even under conditions with different temperatures and relative humidities, the developer in a developing apparatus of a copying machine is required to reduce the changes in the properties. Carrier core particles, which make up carrier particles, are also required to reduce their property changes in various environments, in other words, to be less dependent on environments.

The inventors of the present invention thoroughly investigated the cause for the physical properties, such as the amount of charge and resistance values, of the carrier change depending on the usage environment, and found out that the physical property change of the carrier core particle greatly influences the physical properties of the coated carrier particle. It has also been found out that the conventional carrier core particles as represented by LP1 are inadequate to reduce environmental dependency. Actually, the amount of charge and resistance value of some carrier core particles greatly deteriorate in relatively high relative-humidity environments. Such carrier core particles can be greatly affected by environmental variations and therefore may degrade image quality.

The object of the present invention is to provide a carrier core particle for an electrophotographic developer having excellent electric and magnetic properties and low environmental dependency.

Yet another object of the present invention is to provide a carrier for an electrophotographic developer having excellent electric and magnetic properties and low environmental dependency.

Yet another object of the present invention is to provide an electrophotographic developer capable of forming good quality images under various environments.

Solution to Problem

For the purpose of achieving a carrier core particle having excellent electric and magnetic properties and low environmental dependency, the inventors of the present invention firstly conceived to use manganese and iron as main ingredients of the core composition to obtain good magnetic properties as basic characteristics and secondly conceived to add a predetermined amount of magnesium (Mg) and calcium (Ca) as metal elements of the carrier core particle ingredients to further improve the magnetic and electric properties and reduce the environmental dependency.

The following mechanism probably works to make these ingredients into a carrier core particle with excellent electric and magnetic properties and low environmental dependency. A carrier core particle inevitably contains a trace amount of silicon (Si) without intentionally adding silicon (Si), and naturally an oxide ($SiO_2$) of the trace amount of silicon (Si) exists on the surface of the carrier core particle. The silicon (Si) in the oxide probably absorbs moisture contained in a relatively large amount in high-humidity environments and induces charge leakage, resulting in reduction of resistance value under high humidity environments. However, at least one of Ca and Mg added as described above reacts with Si existing as an oxide on the surface of the carrier core particle to form a complex metal oxide. The complex metal oxide derived from Si is considered to prevent charge leakage under the high-humidity environments and to prevent the resistance value of the carrier core particle from decreasing, thereby lowering environmental dependency.

A part of at least one of Mg and Ca that are added in a predetermined amount and have a relatively small ionic radius forms solid solutions in spinel crystal structure of main ingredients of the core composition. This relatively stabilizes the crystal structure of the core composition of the carrier core particle. The stabilized crystal structure makes it hard for $Fe_2O_3$ formed by oxidation in the carrier component to be precipitated, and as a result, facilitates moving magnetic domain walls according to magnetic field variations and probably provides a sharp rise of magnetization. The predetermined amount of Mg and Ca to be added will be discussed. For example, the amount of charge tends to increase with an increase of the Ca content, but the magnetization tends to slightly decrease. With an appropriate amount of addition of Mg and Ca, both the electric and magnetic properties can be improved. It should be noted that the content of Mg and other elements in a carrier core particle may be expressed by mole fractions in this description.

In addition, an excess amount of oxygen is added into the core composition, or the carrier core particle, to further reduce environmental dependency.

Accordingly, the carrier core particle for an electrophotographic developer of the present invention includes a core composition expressed by a general formula: $(Mn_xMg_yCa_z)Fe_wO_{4+v}$ ($x+y+z+w=3$, $-0.003<v$) as a main ingredient, wherein $0.05\leq y\leq 0.35$ and $0.005\leq z\leq 0.024$.

The carrier core particle is expressed at first by a general formula: $(Mn_xMg_yCa_z)Fe_wO_{4+v}$ ($x+y+z+w=3$, $-0.003<v$). This represents that the amount of oxygen satisfies $-0.003<v$ and therefore the carrier core particle contains slightly excess oxygen. Such a carrier core particle satisfying the value v can be obtained through, for instance, a method for manufacturing a carrier core particle for electrophotographic developer that will be described later. The carrier core particle can prevent the resistance value from decreasing in high-humidity environments. The carrier core particle according to the invention further contains $0.05\leq y\leq 0.35$ of Mg and $0.005\leq z\leq 0.024$ of Ca. The carrier core particle having such a composition, more specifically, the carrier core particle containing a predetermined amount of Mg and Ca within the described range can possess excellent electric and magnetic properties and low environmental dependency.

In the core composition expressed by the general formula of $(Mn_xMg_yCa_z)Fe_wO_{4+v}$, the composition in parentheses, i.e., $(Mn_xMg_yCa_z)$ occupies mainly an A-site of the crystal structure, while the Fe part occupies mainly a B-site of the crystal structure. In addition, the total of x, y and z is close to 1, i.e., $x+y+z\approx 1$.

A method for calculating an oxygen amount v will be described. Before calculating the oxygen amount v, Mn is assumed to be divalent in the present invention. First, the average valence of Fe is calculated. The average valence of Fe is obtained by quantifying $Fe^{2+}$ and total Fe through oxidation-reduction titration and then calculating the average valence of Fe from the resultant quantities of $Fe^{2+}$ and $Fe^{3+}$. The quantification of $Fe^{2+}$ and total Fe will be described in detail.

(1) Quantification of $Fe^{2+}$

First, ferrite containing iron elements is dissolved in a hydrochloric acid (HCl) solution, which is reducible acid, with carbon dioxide bubbling. Secondly, the amount of $Fe^{2+}$ ion in the solution is quantitatively analyzed through potential difference titration with potassium permanganate solution, thereby obtaining the titer of $Fe^{2+}$.

(2) Quantification of Total Fe

Ferrite containing iron-element, which weighs the same amount as the ferrite used to quantify $Fe^{2+}$, is dissolved in mixed acid solution of hydrochloric acid and nitric acid. This solution is evaporated to dryness, and then a sulfuric acid solution is added to the solution for redissolution to volatilize excess hydrochloric acid and nitric acid. Solid Al is added to the remaining solution to reduce the $Fe^{3+}$ in the solution to $Fe^{2+}$. Subsequently, the solution is measured by the same analysis method used to quantify $Fe^{2+}$ to obtain the titer of the total Fe.

(3) Calculation of Average Valence of Fe

The description (1) provides the determinate quantity of $Fe^{2+}$, and therefore ((2) titer−(1) titer) represents the quantity of $Fe^{3+}$. The following formula determines the average valence number of Fe.

$$\text{The average valence of Fe}=\{3\times((2)\text{ titer}-(1)\text{ titer})+2\times(1)\text{ titer}\}/(2)\text{ titer}$$

In addition to the aforementioned method, some different oxidation reduction titration methods are applicable to quantitatively determine the valence of the iron element; however, the aforementioned method is regarded as superior to others because the reaction required for analysis is simple, the results can be read easily, a general reagent and analysis device can achieve sufficient accuracy, and skilled analyzers are not needed.

Based on the electroneutrality principle, the relationship, Mn valence (valence of +2)×x+average valence of Fe×(3−x)= oxygen valence (valence of −2)×(4+w), is established in a structural formula. From the above formula, the value w is determined.

An analysis method on the Si, Mn, Ca and Mg of the carrier core particle according to the present invention will be described.

(Analysis on $SiO_2$ Content and Si Content)

The $SiO_2$ content in the carrier core particle was quantitatively analyzed in conformity with the silica gravimetric method shown in JIS M8214-1995. The $SiO_2$ contents in the carrier core particles described in this invention are quantities of $SiO_2$ that were quantitatively analyzed through the silica gravimetric method.

(Analysis on Mn)

The Mn content in the carrier core particle was quantitatively analyzed in conformity with a ferromanganese analysis method (potential difference titration) shown in JIS G1311-1987. The Mn contents of the carrier core particles described in this invention are quantities of Mn that were quantitatively analyzed through the ferromanganese analysis method (potential difference titration).

(Analysis on Mg and Ca)

The contents of Mg and Ca in the carrier core particles were analyzed by the following method. The carrier core particles of the invention were dissolved in an acid solution and quantitatively analyzed with ICP. The contents of Mg and Ca in the carrier core particles described in this invention are quantities of Mg and Ca that were quantitatively analyzed with the ICP. The ICP analysis was conducted with an ICP emission spectrometer (produced by SHIMADZU CORPORATION, model: ICPS-7510).

Preferably, the relations, $0.10 \leq y \leq 0.25$ and $0.007 \leq z \leq 0.015$, hold to improve the electric and magnetic properties.

Another aspect of the present invention is directed to a carrier for an electrophotographic developer that is used to develop electrophotographic images and includes a carrier core particle having a core composition expressed by a general formula: $(Mn_xMg_yCa_z)\ Fe_wO_{4+v}$ ($x+y+z+w=3$, $-0.003<v$) as a main ingredient, wherein $0.05 \leq y \leq 0.35$ and $0.005 \leq z \leq 0.024$, and a resin that coats the surface of the carrier core particle for the electrophotographic developer.

Such a carrier for the electrophotographic developer including the carrier core particle having the aforementioned composition has excellent electric and magnetic properties and low environmental dependency.

Yet another aspect of the present invention is directed to an electrophotographic developer that is used to develop electrophotographic images and includes a carrier having a carrier core particle having a core composition expressed by a general formula: $(Mn_xMg_yCa_z)\ Fe_wO_{4+v}$ ($x+y+z+w=3$, $-0.003<v$) as a main ingredient, wherein $0.05 \leq y \leq 0.35$ and $0.005 \leq z \leq 0.024$, and a resin that coats the surface of the carrier core particle for the electrophotographic developer, and a toner that can be triboelectrically charged by frictional contact with the carrier for development of electrophotographic images.

Such an electrophotographic developer having the carrier thus composed can form images with excellent quality in various environments.

Advantageous Effects of Invention

The carrier core particle for an electrophotographic developer according to the invention has excellent electric and magnetic properties and low environmental dependency.

The carrier for the electrophotographic developer according to the invention has excellent electric and magnetic properties and low environmental dependency.

The electrophotographic developer according to the invention can form good quality images in various environments.

DESCRIPTION OF EMBODIMENTS

With reference to the drawings, an embodiment of the present invention will be described. First, carrier core particles according to the embodiment of the invention will be described.

Carrier core particles according to the embodiment of the invention are roughly spherical in shape, approximately 35 μm in diameter, and have proper particle size distribution. The diameter implies a volume mean diameter. The diameter and particle size distribution are set to any values to satisfy the required developer characteristics, yields of manufacturing steps and some other factors. On the surface of the carrier core particle, there are fine asperities formed in a firing step which will be described later.

Carrier particles of the embodiment of the invention are also roughly spherical in shape as with the carrier core particles. A carrier particle is made by coating, or covering, a carrier core particle with a thin resin film and has almost the same diameter as the carrier core particle. The surface of the carrier particle is almost completely covered with resin, which is different from the carrier core particle.

Developer according to the embodiment of the invention includes the carrier and toner. The toner particles are also roughly spherical in shape. The toner contains mainly styrene acrylic-based resin or polyester-based resin and a predetermined amount of pigment, wax and other ingredients combined therewith. The toner of this type is manufactured by, for example, a pulverizing method or polymerizing method. The toner particle in use is, for example, approximately 5 μm in diameter, which is about one-seventh of the diameter of the carrier particle. The compounding ratio of the toner and carrier is also set to any value according to the required developer characteristics. The developer of this type is manufactured by mixing a predetermined amount of the carrier and toner by a suitable mixer.

Figure 1:
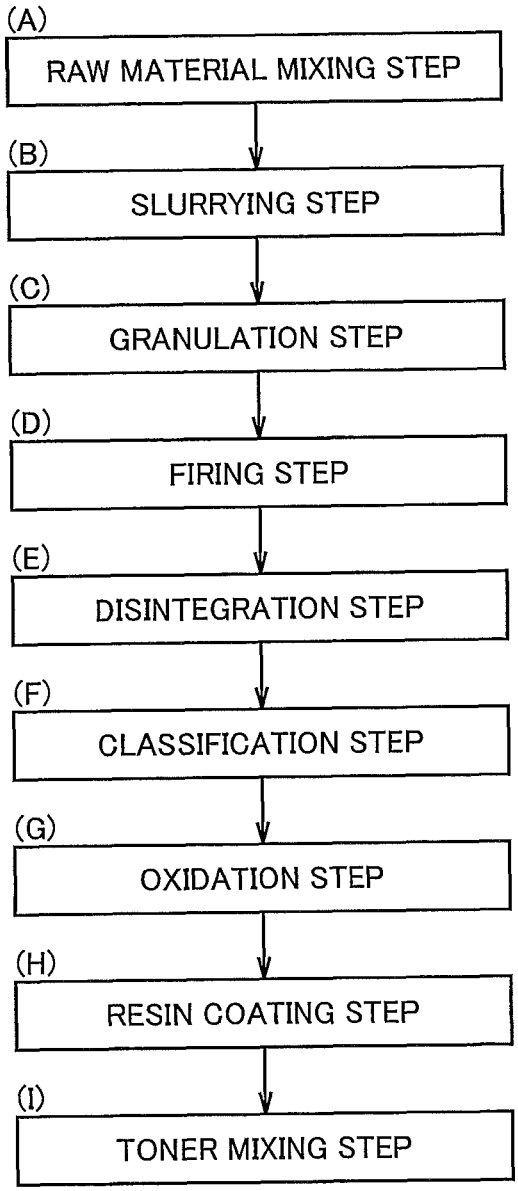
FIG. 1 is a flow chart showing main steps of a method for manufacturing a carrier core particle according to an embodiment of the invention.

A method for manufacturing the carrier core particle according to the embodiment of the invention will be described. FIG. 1 is a flow chart showing main steps in the method for manufacturing the carrier core particle according to the embodiment of the invention. Along FIG. 1, the method for manufacturing the carrier core particle according to the embodiment of the invention will be described below.

First, a raw material containing calcium, a raw material containing magnesium, a raw material containing manganese, a raw material containing iron are prepared. The prepared raw materials are formulated at an appropriate compounding ratio to meet the required properties, and mixed (FIG. 1(A)). The appropriate compounding ratio is designed so as to obtain the final carrier core particle as will be described later.

The iron raw material making up the carrier core particle according to the embodiment of the invention can be metallic iron or an oxide thereof, and more specifically, preferred materials include $Fe_2O_3$, $Fe_3O_4$ and Fe, which can stably exist at room temperature and atmospheric pressure. The manganese raw material can be manganese metal or an oxide thereof, and more specifically, preferred materials include Mn metal, $MnO_2$, $Mn_2O_3$, $Mn_3O_4$, and $MnCO_3$, which can stably exist at room temperature and atmospheric pressure. Preferably used raw materials containing calcium include calcium metal or oxide thereof, more specifically, $CaCO_3$, which is a carbonate, $Ca(OH)_2$, which is a hydroxide, CaO, which is an oxide, and so on. Preferably used raw materials containing magnesium include magnesium metal or an oxide thereof, more specifically, $MgCO_3$, which is a carbonate, $Mg(OH)_2$, which is a hydroxide, MgO, which is an oxide, and so on. Alternatively, the aforementioned raw materials (iron raw material, manganese raw material, calcium raw material, magnesium raw material, etc.) can be used respectively or can be mixed so as to obtain a target composition. The raw material of choice can be calcined and pulverized before use. The aforementioned iron raw material and manganese raw material contain a trace amount of magnesium.

Next, the mixed raw materials are slurried (FIG. 1(B)). In other words, these raw materials are weighed to make a target composition of the carrier core particle and mixed together to make a slurry raw material.

In the process for manufacturing the carrier core particle according to the invention, a reducing agent may be added to the slurry raw material at a part of a firing step, which will be described later, to accelerate reduction reaction. A preferred reducing agent may be carbon powder, polycarboxylic acid-based organic substance, polyacrylic acid-based organic substance, maleic acid, acetic acid, polyvinyl alcohol (PVA)-based organic substance, or mixtures thereof.

Water is added to the slurry raw material that is then mixed and agitated so as to contain 40 wt % or more of solids, preferably 50 wt % or more. The slurry raw material containing 50 wt % or more of solids is preferable because such a material can maintain the strength of granulated pellets.

Subsequently, the slurried raw material is granulated (FIG. 1(C)). Granulation of the slurry obtained by mixing and agitation is performed with a spray dryer. Note that it is further preferable to subject the slurry to wet pulverization before the granulation step.

The temperature of an atmosphere during spray drying can be set to approximately 100° C. to 300° C. This can provide granulated powder whose particles are approximately 10 to 200 μm in diameter. In consideration of the final particle diameter of a product, it is preferable to filter the granulated powder with a vibrating sieve or the like to remove coarse particles and fine powder for particle size adjustment at this point of time.

The granulated material is then fired (FIG. 1(D)). Specifically, the obtained granulated powder is placed in a furnace heated to approximately 900° C. to 1500° C. and fired for 1 to 24 hours to produce a target fired material. During firing, the oxygen concentration in the firing furnace can be set to any value, but should be enough to advance ferritization reaction. Specifically speaking, when the furnace is heated to 1200° C., a gas is introduced and flows in the furnace to adjust the oxygen concentration to $10^{-7}$% to 3%.

Alternatively, a reduction atmosphere required for ferritization can be made by adjusting the aforementioned reducing agent. To achieve a reaction speed that provides sufficient productivity in an industrial operation, the preferable temperature is 900° C. or higher. If the firing temperature is 1500° C. or lower, the particles are not excessively sintered and can remain in the form of powder upon completion of firing.

One of the measures of adding a slightly excess amount of oxygen in the core composition may be to set the oxygen concentration during cooling of the core particles in the firing step to a predetermined value or higher. Specifically, the core particles can be cooled to approximately room temperature in the firing step under an atmosphere at a predetermined oxygen concentration, for example, at an oxygen concentration higher than 0.03%. More specifically, a gas with an oxygen concentration higher than 0.03% is introduced into the electric furnace and continues flowing during the cooling step. This allows the internal layer of the carrier core particle to contain ferrite with an excess amount of oxygen. In other words, the value v can be $-0.003<v$. If the oxygen concentration of the gas is 0.03% or lower in the cooling step, the amount of oxygen in the internal layer becomes relatively low. In other words, the value v may be −0.003 or lower. Therefore, the cooling operation should be performed in an environment at the aforementioned oxygen concentration.

It is preferable at this stage to adjust the size of particles of the fired material again. The fired material is coarsely ground by a hammer mill or the like. In other words, the fired granules are disintegrated (FIG. 1(E)). After disintegration, classification is carried out with a vibrating sieve or the like. In other words, the disintegrated granules are classified (FIG. 1(F)) to obtain carrier core particles with a desired diameter.

Then, the classified granules undergo oxidation (FIG. 1(G)). The surfaces of the carrier core particles obtained at this stage are heat-treated (oxidized) to increase the breakdown voltage to 250 V or higher, thereby imparting an appropriate electric resistance value, from $1\times10^{6}$ to $1\times10^{13}$ Ω·cm, to the carrier core particles. Increasing the electric resistance value of the carrier core particle through oxidation can reduce the possibility of scattering of the carrier caused by charge leakage.

More specifically, the granules are placed in an atmosphere at an oxygen concentration of 10% to 100%, at a temperature of 200° C. to 700° C., for 0.1 to 24 hours to obtain the target carrier core particle. More preferably, the granules are placed at a temperature of 250° C. to 600° C. for 0.5 to 20 hours, further more preferably, at a temperature of 300° C. to 550° C. for 1 to 12 hours. In this manner, the carrier core particle according to the embodiment of the invention is manufactured. Note that the oxidation step is optionally executed when necessary.

The carrier core particle thus obtained is coated with resin (FIG. 1(H)). Specifically, the carrier core particle obtained according to the invention is coated with silicone-based resin, acrylic resin, or the like. A carrier for an electrophotographic developer according to the embodiment of the invention is achieved in this manner. The coating with silicone-based resin, acrylic resin or the like can be done by well-known techniques. The carrier for the electrophotographic developer according to the invention includes a carrier core particle having a core composition expressed by a general formula: $(Mn_xMg_yCa_z)\ Fe_WO_{4+V}$ ($x+y+z+w=3$, $-0.003<v$) as a main ingredient, wherein $0.05 \leq y \leq 0.35$ and $0.005 \leq z \leq 0.024$, and a resin that coats the surface of the carrier core particle for the electrophotographic developer.

The carrier for the electrophotographic developer that includes the carrier core particle having the aforementioned composition has excellent electric and magnetic properties and low environmental dependency.

Next, the carrier thus obtained and toner are mixed in predetermined amounts (FIG. 1(I)). Specifically, the carrier, which is obtained through the above mentioned manufacturing method, for the electrophotographic developer according to the invention is mixed with an appropriate well-known toner. In this manner, the electrophotographic developer according to the embodiment of the invention can be achieved. The carrier and toner are mixed by any type of mixer, for example, a ball mill. The electrophotographic developer according to the invention is used to develop electrophotographic images and contains the carrier and toner, the carrier including a carrier core particle that has a core composition expressed by a general formula: $(Mn_xMg_yCa_z)Fe_wO_{4+v}$ ($x+y+z+w=3$, $-0.003<v$) as a main ingredient, wherein $0.05 \leq y \leq 0.35$ and $0.005 \leq z \leq 0.024$, and a resin that coats the surface of the carrier core particle, and the toner that can be triboelectrically charged by frictional contact with the carrier for development of electrophotographic images.

Such an electrophotographic developer that includes the carrier having the aforementioned composition can form high quality images in various environments.

EXAMPLES

Example 1

27.3 kg of $Fe_2O_3$ (average particle diameter: 0.6 μm), 13.05 kg of $Mn_3O_4$ (average particle diameter: 2 μm) and 4.65 kg of $MgFeO_4$ were dispersed in 15 kg of water, and 270 g of ammonium polycarboxylate-based dispersant, 135 g of carbon black reducing agent and 225 g of $CaCO_3$ were added to make a mixture. The solid concentration of the mixture was measured and results in 75 wt %. The mixture was pulverized by a wet ball mill (media diameter: 2 mm) to obtain mixture slurry.

The slurry was sprayed into hot air of approximately 130° C. by a spray dryer and turned into dried granulated powder. At this stage, granulated powder particles out of the target particle size distribution were removed by a sieve. This granulated powder was placed in an electric furnace and fired at 1090° C. for three hours. During firing, gas was controlled to flow in the electric furnace such that the atmosphere in the electric furnace was adjusted to have an oxygen concentration of 0.8%, or namely 8000 ppm. The cooling temperature during the firing step was 200° C./hour. The cooling temperature during the firing step means a rate in which the temperature upon the completion of the firing step goes down to room temperature in this description, and 200° C./hour or lower is preferable and 120° C./hour or lower is more preferable. The obtained fired material was disintegrated and then classified by a sieve, thereby obtaining carrier core particles whose average particle diameter is 25 μm. The resultant carrier core particle was then maintained in an atmosphere at 465° C. for one hour for oxidation to obtain a carrier core particle of Example 1. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method. For particle size distribution measurement, Microtrac Model 9320-X100 produced by NIKKISO CO., LTD. was used. For the oxygen concentration, a zirconia type oxygen analyzer (ECOAZ TB-II F-S, produced by DAIICHI NEKKEN CO., LTD) was used to measure the oxygen concentration under an atmosphere in the furnace.

Example 2

The carrier core particle of Example 2 was obtained in the same manner as in Example 1, but the added $Fe_2O_3$ was 9.1 kg, $Mn_3O_4$ was 4.35 kg and $MgFeO_4$ was 3.67 kg, they were dispersed in 7 kg of water, and 103 g of ammonium polycarboxylate-based dispersant, 51 g of carbon black reducing agent and 86 g of $CaCO_3$ were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method.

Example 3

The carrier core particle of Example 3 was obtained in the same manner as in Example 1, but the added $Fe_2O_3$ was 9.1 kg, $Mn_3O_4$ was 4.35 kg and $MgFeO_4$ was 6.33 kg, they were dispersed in 8.1 kg of water, and 119 g of ammonium polycarboxylate-based dispersant, 59 g of carbon black reducing agent and 99 g of $CaCO_3$ were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method.

Example 4

The carrier core particle of Example 4 was obtained in the same manner as in Example 1, but the added $Fe_2O_3$ was 9.1 kg, $Mn_3O_4$ was 4.35 kg and $MgFeO_4$ was 1.55 kg, they were dispersed in 5 kg of water, and 90 g of ammonium polycarboxylate-based dispersant, 45 g of carbon black reducing agent, 30 g of colloidal silica as $SiO_2$ raw material (solid concentration of 50 wt %) and 37.5 g of $CaCO_3$ were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method.

Example 5

The carrier core particle of Example 5 was obtained in the same manner as in Example 1, but the added $Fe_2O_3$ was 9.1 kg, $Mn_3O_4$ was 4.35 kg and $MgFeO_4$ was 1.55 kg, they were dispersed in 5 kg of water, and 90 g of ammonium polycarboxylate-based dispersant, 45 g of carbon black reducing agent, 30 g of colloidal silica as $SiO_2$ raw material (solid concentration of 50 wt %) and 75 g of $CaCO_3$ were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method.

Example 6

The carrier core particle of Example 6 was obtained in the same manner as in Example 1 except for that: 30.61 kg of $Fe_2O_3$, 13.16 kg of $Mn_3O_4$, 1.02 kg of MgO and 0.22 kg (220 g) of $CaCO_3$ were mixed by a vibrating mill; the mixed ingredient was calcined at 900° C. for 2 hours in an atmosphere; the calcined ingredient was pulverized with the vibrating mill until its volume mean diameter was reduced to 1.5 μm and the remainder on a 45 μm sieve was reduced to 0.5 wt % or less and obtained ingredient was used as calcined material; 45.2 kg of the calcined material was dispersed in 15 kg of water; and 270 g of ammonium polycarboxylate-based dispersant and 135 g of carbon black reducing agent were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method. In addition, parenthesized numbers in Table 1 denote before-calcined compounding ratios.

Comparative Example 1

The carrier core particle of Comparative Example 1 was obtained in the same manner as in Example 1 except for that: 10.8 kg of $Fe_2O_3$ and 4.2 kg of $Mn_3O_4$ were dispersed in 5 kg of water; and 90 g of ammonium polycarboxylate-based dispersant, 45 g of carbon black reducing agent, 30 g of colloidal silica as $SiO_2$ raw material (solid concentration of 50 wt %) and 75 g of $CaCO_3$ were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method. In addition, the carrier core composition according to Comparative Example 1 contains magnesium that probably derives from the iron raw material and manganese raw material, because they contain a trace amount of magnesium.

Comparative Example 2

The carrier core particle of Comparative Example 2 was obtained in the same manner as in Example 1 except for that: 10.8 kg of $Fe_2O_3$ and 4.2 kg of $Mn_3O_4$ were dispersed in 5 kg of water; and 90 g of ammonium polycarboxylate-based dispersant, 45 g of carbon black reducing agent, 30 g of colloidal silica as $SiO_2$ raw material (solid concentration of 50 wt %) and 127 g of $MgCO_3$ were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method.

Comparative Example 3

The carrier core particle of Comparative Example 3 was obtained in the same manner as in Example 1 except for that: 9.1 kg of $Fe_2O_3$, 4.35 kg of $Mn_3O_4$ and 1.55 kg of $MgFeO_4$ were dispersed in 5 kg of water; and 90 g of ammonium polycarboxylate-based dispersant, 45 g of carbon black reducing agent and 30 g of colloidal silica as $SiO_2$ raw material (solid concentration of 50 wt %) were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method.

Comparative Example 4

The carrier core particle of Comparative Example 4 was obtained in the same manner as in Example 1 except for that: 18.2 kg of $Fe_2O_3$, 8.7 kg of $Mn_3O_4$ and 3.1 kg of $MgFeO_4$ were dispersed in 10 kg of water; and 180 g of ammonium polycarboxylate-based dispersant, 90 g of carbon black reducing agent and 60 g of colloidal silica as $SiO_2$ raw material (solid concentration of 50 wt %) were added. Table 1 shows the compounding ratios of the raw materials and the compositions of the carrier core particle, while Table 2 shows the electric and magnetic properties of the resultant carrier core particle. Note that the core composition listed in Table 1 was obtained by measuring the carrier core particle through the aforementioned analysis method.

TABLE 1

| | COMPOUNDING RATIO | | | | | | | | | | |
|---|---|---|---|---|---|---|---|---|---|---|---|
| | $Fe_2O_3$ (kg) | $Mn_3O_4$ (kg) | $MgFeO_4$ (kg) | $SiO_2$ (g) | $MgCO_3$ (g) | MgO (kg) | $CaCO_3$ (g) | CALCINED MATERIAL (g) | CB (g) | DISPERSANT (g) | WATER (kg) |
| EXAMPLE 1 | 27.3 | 13.05 | 4.65 | 0 | 0 | 0 | 225 | 0 | 135 | 270 | 15 |
| EXAMPLE 2 | 9.1 | 4.35 | 3.67 | 0 | 0 | 0 | 86 | 0 | 51 | 103 | 7 |
| EXAMPLE 3 | 9.1 | 4.35 | 6.33 | 0 | 0 | 0 | 99 | 0 | 59 | 119 | 8.1 |
| EXAMPLE 4 | 9.1 | 4.35 | 1.55 | 30 | 0 | 0 | 37.5 | 0 | 45 | 90 | 5 |
| EXAMPLE 5 | 9.1 | 4.35 | 1.55 | 30 | 0 | 0 | 75 | 0 | 45 | 90 | 5 |
| EXAMPLE 6 | (30.61) | (13.16) | 0 | 0 | 0 | (1.02) | (220) | 45.2 | 135 | 270 | 15 |
| COMPARATIVE EXAMPLE 1 | 10.8 | 4.2 | 0 | 30 | 0 | 0 | 75 | 0 | 45 | 90 | 5 |
| COMPARATIVE EXAMPLE 2 | 10.8 | 4.2 | 0 | 30 | 127 | 0 | 0 | 0 | 45 | 90 | 5 |
| COMPARATIVE EXAMPLE 3 | 9.1 | 4.35 | 1.55 | 30 | 0 | 0 | 15 | 0 | 45 | 90 | 5 |
| COMPARATIVE EXAMPLE 4 | 18.2 | 8.7 | 3.1 | 60 | 0 | 0 | 300 | 0 | 90 | 180 | 10 |

TABLE 1-continued

| | SOLID CONCENT RATION wt % | CARRIER CORE MATERIAL COMPOSITION Fe wt % | Mn wt % | Mg wt % | Ca wt % | $SiO_2$ wt % |
|---|---|---|---|---|---|---|
| EXAMPLE 1 | 75 | 47.68 | 20.13 | 1.34 | 0.24 | 0.16 |
| EXAMPLE 2 | 71 | 48.74 | 17.81 | 2.56 | 0.24 | 0.15 |
| EXAMPLE 3 | 71 | 49.17 | 15.65 | 3.69 | 0.26 | 0.13 |
| EXAMPLE 4 | 75 | 47.70 | 20.17 | 1.35 | 0.12 | 0.26 |
| EXAMPLE 5 | 75 | 47.72 | 20.20 | 1.35 | 0.21 | 0.27 |
| EXAMPLE 6 | 75 | 47.48 | 20.02 | 1.39 | 0.21 | 0.06 |
| COMPARATIVE EXAMPLE 1 | 75 | 51.00 | 20.00 | 0.08 | 0.17 | 0.24 |
| COMPARATIVE EXAMPLE 2 | 75 | 51.00 | 20.00 | 0.30 | 0.00 | 0.24 |
| COMPARATIVE EXAMPLE 3 | 75 | 48.19 | 19.94 | 1.35 | 0.07 | 0.26 |
| COMPARATIVE EXAMPLE 4 | 75 | 47.33 | 19.95 | 1.26 | 0.42 | 0.25 |

TABLE 2

| | MAGNETIZATION σs (emu/g) | σ1k (emu/g) | σ500 (emu/g) | RESISTANCE VALUE IN HIGH-TEMPERATURE AND HIGH-HUMIDITY ENVIRONMENT 100 (Ω· cm) | 250 (Ω· cm) | 500 (Ω· cm) | 750 (Ω· cm) | 1000 (Ω· cm) |
|---|---|---|---|---|---|---|---|---|
| EXAMPLE 1 | 66.6 | 56.8 | 39.5 | 8.1E+08 | 3.9E+08 | 1.9E+08 | 1.2E+08 | 9.0E+07 |
| EXAMPLE 2 | 62.1 | 54.3 | 39.0 | 7.0E+08 | 5.3E+08 | 3.9E+08 | 2.4E+08 | 1.6E+08 |
| EXAMPLE 3 | 58.9 | 52.8 | 38.2 | 7.3E+08 | 5.8E+08 | 4.2E+08 | 3.0E+08 | 2.5E+08 |
| EXAMPLE 4 | 68.6 | 58.9 | 38.5 | 5.3E+08 | 4.2E+08 | 2.5E+08 | 1.7E+08 | 1.3E+08 |
| EXAMPLE 5 | 65.8 | 57.6 | 38.2 | 7.2E+08 | 5.1E+08 | 3.0E+08 | 2.0E+08 | 1.5E+08 |
| EXAMPLE 6 | 69.2 | 59.1 | 39.2 | 4.8E+08 | 2.5E+08 | 1.3E+08 | 8.6E+08 | 8.3E+07 |
| COMPARATIVE EXAMPLE 1 | 73.7 | 59.7 | 37.3 | 1.7E+08 | 1.1E+08 | 6.8+07 | 4.7E+07 | 3.5E+07 |
| COMPARATIVE EXAMPLE 2 | 71.6 | 59.2 | 37.7 | 2.3E+08 | 1.3E+08 | 6.8E+07 | 4.6E+07 | 3.5E+07 |
| COMPARATIVE EXAMPLE 3 | 67.6 | 65.7 | 38.6 | 6.3E+08 | 3.4E+08 | 1.7E+08 | 1.0E+08 | 7.2E+07 |
| COMPARATIVE EXAMPLE 4 | 57.5 | 49.8 | 37.5 | 6.4E+08 | 4.4E+08 | 2.5E+08 | 1.5E+08 | 1.2E+08 |

| | CORE CHARGE AMOUNT (μ C/g) | MOLE FRACTION x — | y — | z — | w — | v — |
|---|---|---|---|---|---|---|
| EXAMPLE 1 | 17.90 | 0.858 | 0.129 | 0.014 | 1.999 | −0.0003 |
| EXAMPLE 2 | 16.52 | 0.743 | 0.242 | 0.014 | 2.001 | 0.0006 |
| EXAMPLE 3 | 15.50 | 0.645 | 0.344 | 0.015 | 1.996 | −0.0022 |
| EXAMPLE 4 | 17.00 | 0.860 | 0.131 | 0.007 | 2.002 | −0.0012 |
| EXAMPLE 5 | 17.50 | 0.860 | 0.130 | 0.012 | 1.998 | 0.0011 |
| EXAMPLE 6 | 18.50 | 0.856 | 0.134 | 0.012 | 1.998 | −0.0010 |
| COMPARATIVE EXAMPLE 1 | 14.46 | 0.850 | 0.008 | 0.010 | 2.132 | 0.066 |
| COMPARATIVE EXAMPLE 2 | 10.40 | 0.847 | 0.029 | 0.000 | 2.124 | 0.062 |
| COMPARATIVE EXAMPLE 3 | 12.16 | 0.849 | 0.130 | 0.004 | 2.017 | 0.0087 |
| COMPARATIVE EXAMPLE 4 | 16.62 | 0.856 | 0.122 | 0.025 | 1.997 | −0.0013 |

The item "core charge amount" in Table 2 denotes amounts of charge held by a core, or a carrier core particle. Measurement of the amount of charge will be described. 9.5 g of the carrier core particle and 0.5 g of a toner for commercial full-color copying machines were put in a 100-ml glass bottle with a cap and the bottle was placed in an environment at 25° C. and 50% RH for 12 hours to control the moisture. The moisture-controlled carrier core particles and toner were shaken for 30 minutes by a shaker and mixed. The shaker in use was a model NEW-YS produced by YAYOI CO., LTD., and operated at a shaking speed of 200/min and at an angle of 60°. From the mixture of the carrier core particles and toner, 500 mg of the mixture was weighed out and measured for the amount of charge by a charge measurement apparatus. In this embodiment, the measurement apparatus in use was a model STC-1-C1 produced by JAPAN PIO-TECH CO., LTD., and operated at a suction pressure of 5.0 kPa with a suction mesh made of SUS and with 795 mesh. Two samples of the same were measured and the average of the measured values is defined as the core charge amount. The core charge amount is calculated by the following formula: core charge amount (μC (coulomb)/g)=measured charge (nC)×$10^3$×coefficient ($1.0083\times10^{-3}$)÷toner weight (weight before suction (g)−weight after suction (g)).

Measurement of the resistance values will be now described. The carrier core particles were placed in an environment at 30° C. and 75% RH (HH environment) for a day to control moisture and then measured in the environment. First, two SUS (JIS) 304 plates each having a thickness of 2 mm and an electropolished surface were disposed as electrodes on a horizontally-placed insulating plate, or, for example, an acrylic plate coated with Teflon (trade mark) so that the electrodes are spaced 1 mm apart. The two electrode plates were placed so that their normal lines extend in the horizontal direction. After 200±1 mg of powder to be measured was charged in a gap between the two electrode plates, magnets having a cross-sectional area of 240 $mm^2$ were disposed behind the respective electrode plates to form a bridge made of the powder between the electrodes. While keeping the state, DC voltages were applied between the electrodes in the increasing order of the voltage values, and the value of current passing through the powder was measured by a two-terminal method to determine the value of resistance. For the measurement, a super megohmmeter, SM-8215 produced by HIOKI E. E. CORPORATION, was used. The resistance value is expressed by a formula: resistance value (Ω·cm)=measured resistance value (Ω)×cross-sectional area (2.4 $cm^2$)÷inter-electrode distance (0.1 cm). The resistance value (Ω·cm) of the powder applied with the voltages listed in the tables was measured. Note that the magnets in use can be anything as long as they can cause the powder to form a bridge. In this embodiment, a permanent magnet, for example, a ferrite magnet, having a surface magnetic flux density of 1000 gauss or higher was used.

As to the measurement of magnetization, which is a magnetic property, magnetic susceptibility was measured with a VSM (Model VSM-P7 produced by Toei Industry Co., Ltd.). The item "σs" in Table 2 denotes saturation magnetization, and "$\sigma_{1000(1k)}$" indicates magnetization in an external magnetic field of 1000 (1 k) Oe, while "$\sigma_{500}$" indicates magnetization in an external magnetizing field of 500 Oe.

Figure 2:
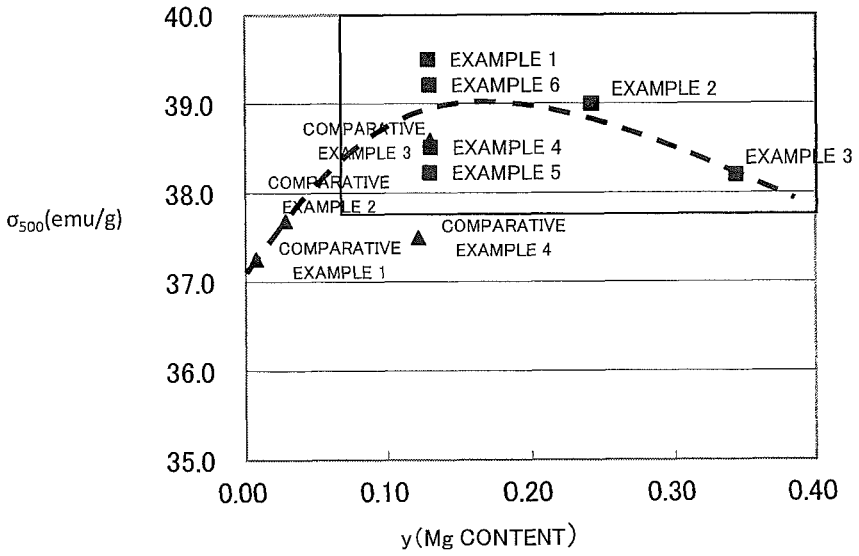
FIG. 2 is a graph showing the relationship between Mg contents and $\sigma_{500}$.
Figure 3:
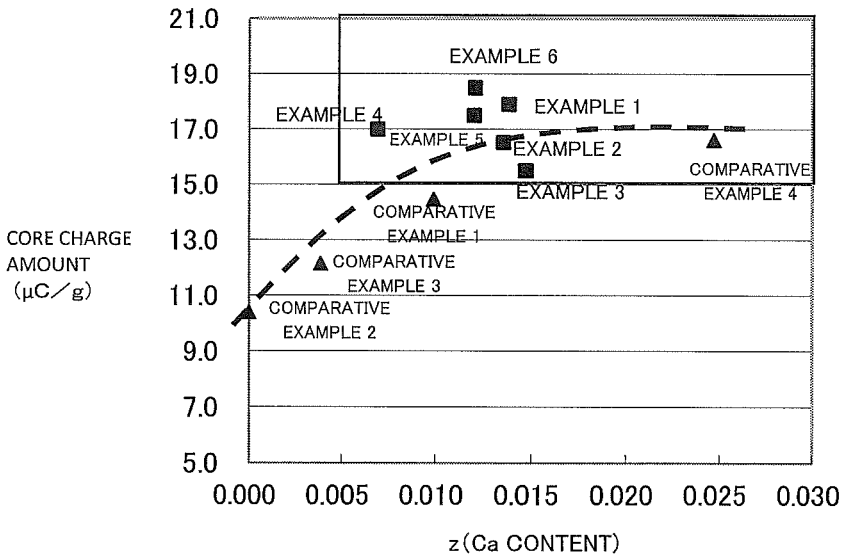
FIG. 3 is a graph showing the relationship between Ca contents and core charge amounts.

The relationship between values y, or Mg contents and $\sigma_{500}$ is shown in FIG. 2. FIG. 2 is a graph showing the relationship between Mg contents and $\sigma_{500}$. In FIG. 2, the vertical axis represents values of $\sigma_{500}$, while the horizontal axis represents values of y (Mg contents). The relationship between values z, or Ca contents and core charge amounts is shown in FIG. 3. FIG. 3 is a graph showing the relationship between the Ca contents and core charge amounts. In FIG. 3, the vertical axis represents core charge amounts, while the horizontal axis represents values of z (Ca contents). The dotted line in FIG. 2 shows the values of magnetization $\sigma_{500}$ corresponding to each value of y by referring to Examples and Comparative Examples. The dotted line in FIG. 3 shows the values of the core charge amount corresponding to each value of z by referring to Examples and Comparative Examples.

In order to suppress the increase in carrier scattering involved in the increasing speed of copying machines, it is required for a value of $\sigma_{500}$, as magnetic property, to be 38 emu/g or higher, and more preferably to be 38.5 emu/g or higher. The core charge amount associated with the electric properties is required to be 13 μC/g or higher, and more preferably 16 μC/g or higher, to reduce changes in carrier's physical property derived from a prolonged use of developer, or more specifically, to reduce changes in carrier's physical property due to peeling of coating resin on the surface of the carrier caused by a long period of use.

FIGS. 2 and 3 and Table 2 show that the magnetization $\sigma_{500}$ reaches its extreme value or maximum value around y=0.13. The magnetization $\sigma_{500}$ of Comparative Example 4 is as low as 37.5 emu/g, which is probably caused by the high Ca content. Based on the results, it is concluded that the value of y needs to be 0.05 to 0.35 to make the magnetization value in the low magnetic field high, or more specifically, to increase the value of the magnetization σ500 to 38 emu/g or higher. The core charge amount apparently tends to increase with an increase in z value. In order to increase the core charge amount to 13 μC/g or higher, the value of z probably needs to be 0.005 or higher, but should be 0.024 or lower to keep the high magnetization value.

The following will be the results of a study about environmental dependency. Table 2 shows resistance values obtained in a high-temperature and high-humidity environment (30° C., 75% RH). The carrier core particles having high resistance values can be considered not to decrease in resistance in high-temperature and high-humidity environments, in other words, it can be said that the carrier core particles have low environmental dependency. The carrier core particles in Examples 1 to 6 and Comparative Example 4 have resistance values of 8.0E+07($8\times10^7$) Ω·cm or higher with the application of 1000 V, while the carrier core particles in Comparative Examples 1 to 3 have resistance values of less than 8.0E+07 ($8\times10^7$) Ω·cm, which demonstrates that Examples 1 to 6 and Comparative Example 4 have low environmental dependency.

As described above, y and z within the range defined by Examples 1 to 6 provide excellent electric and magnetic properties and low environmental dependency. More specifically, if $0.05\leq y\leq0.35$ and $0.005\leq z\leq0.024$, the carrier core particles can have excellent electric and magnetic properties and low environmental dependency.

As described above, the carrier core particle for the electrophotographic developer according to the present invention and the carrier for the electrophotographic developer have excellent electric and magnetic properties and low environmental dependency. In addition, the electrophotographic developer according to the invention has excellent properties.

Further improvement of magnetic and electric properties can be achieved with the following composition. If $0.10\leq y\leq0.25$ and $0.007\leq z\leq0.015$, the carrier core particle can have a magnetization, as a magnetic property, of 38.5 emu/g or higher and a core charge amount, as an electric property, of 16 μC/g or higher. Therefore, the carrier core particle that satisfies $0.10\leq y\leq0.25$ and $0.007\leq z\leq0.015$ can further improve the magnetic and electric properties.

In the aforementioned embodiment, the manufacturing method includes preparing a raw material containing calcium, a raw material containing magnesium, a raw material containing manganese and a raw material containing iron and mixing them to obtain the carrier core particle according to the present invention; however, the manufacturing method of the present invention is not limited thereto. For example, $MnFe_2O_4$ and $MgFe_2O_4$ can be prepared and mixed to obtain the carrier core particle according to the invention.

Regarding the oxygen amount v, in the embodiment, the oxygen concentration during the cooling operation in the firing step is set to higher than a predetermined concentration value to add an excess amount of oxygen to the carrier core particle; however, the present invention is not limited thereto. For example, the excess amount of oxygen can be added to the carrier core particle by adjusting the compounding ratio of the raw materials in the mixing step. Alternatively, oxygen can be excessively added to the carrier core particle by performing a step of accelerating the sintering reaction, which is executed before the cooling step, under the same atmosphere as in the cooling step.

The foregoing has described the embodiment of the present invention by referring to the drawings. However, the invention should not be limited to the illustrated embodiment. It should be appreciated that various modifications and changes can be made to the illustrated embodiment within the scope of the appended claims and their equivalents.

INDUSTRIAL APPLICABILITY

The carrier core particle for an electrophotographic developer, the carrier for the electrophotographic developer and the electrophotographic developer according to the invention can be effectively used when applied to copying machines or the like in various usage environments.

The invention claimed is:

1. A carrier core particle for an electrophotographic developer comprising:

a core composition expressed by a general formula: $(Mn_xMg_yCa_z)\ Fe_WO_{4+V}$ ($x+y+z+w=3$, $-0.003<v$) as a main ingredient, wherein $0.05\leq y\leq 0.35$, $0.005\leq z\leq 0.024$, $x>0$, $w>0$, and $x+y+z\approx 1$.

2. The carrier core particle for the electrophotographic developer according to claim 1, wherein $0.10\leq y\leq 0.25$ and $0.007\leq z\leq 0.015$.

3. A carrier for an electrophotographic developer used to develop electrophotographic images, comprising:

a carrier core particle including a core composition expressed by a general formula: $(Mn_xMg_yCa_z)\ Fe_WO_{4+V}$ ($x+y+z+w=3$, $-0.003<v$) as a main ingredient, wherein $0.05\leq y\leq 0.35$, $0.005\leq z\leq 0.024$, $x>0$, $w>0$, and $x+y+z\approx 1$; and a resin that coats the surface of the carrier core particle.

4. An electrophotographic developer used to develop electrophotographic images, comprising:

a carrier including a carrier core particle having a core composition expressed by a general formula: $(Mn_xMg_yCa_z)\ Fe_WO_{4+V}$ ($x+y+z+w=3$, $-0.003<v$) as a main ingredient, wherein $0.05\leq y\leq 0.35$, $0.005\leq z\leq 0.024$, $x>0$, $w>0$, and $x+y+z\approx 1$; and a resin that coats the surface of the carrier core particle; and a toner that can be triboelectrically charged by frictional contact with the carrier for development of electrophotographic images.

* * * * *